US006637298B1

(12) United States Patent
O'Brien et al.

(10) Patent No.: US 6,637,298 B1
(45) Date of Patent: Oct. 28, 2003

(54) SOCKET FOR A SOCKET WRENCH

(76) Inventors: Noel John O'Brien, 30 Abbey View, Adare, County Limerick (IE); Patrick Michael O'Brien, 30 Abbey View, Adare, County Limerick (IE)

( * ) Notice: Subject to any disclaimer, the term of this patent is extended or adjusted under 35 U.S.C. 154(b) by 191 days.

(21) Appl. No.: 09/657,327

(22) Filed: Sep. 7, 2000

Related U.S. Application Data

(63) Continuation-in-part of application No. 09/308,235, filed on Jun. 10, 1999, now abandoned.

(51) Int. Cl.[7] ..... B25B 13/06
(52) U.S. Cl. ..... 81/124.5; 81/185
(58) Field of Search ..... 81/124.4, 124.5, 81/185, DIG. 11

(56) References Cited

U.S. PATENT DOCUMENTS

| | | | | | |
|---|---|---|---|---|---|
| 706,703 | A | * | 8/1902 | Tierce | 81/124.5 |
| 1,281,438 | A | * | 10/1918 | Tuttle | 81/124.5 |
| 1,395,528 | A | | 11/1921 | Silva | 81/124.5 |
| 1,471,451 | A | * | 10/1923 | Crimp | 81/185 |
| 1,539,136 | A | * | 5/1925 | Neel | 81/185 |
| 1,618,715 | A | * | 2/1927 | Lammers et al. | 81/185 |
| 1,626,730 | A | | 5/1927 | Haynes | 81/185 |
| 2,453,901 | A | | 11/1948 | Gonsett et al. | 81/185 |
| 2,697,958 | A | * | 12/1954 | Kozakewich | 81/185 |
| 2,938,417 | A | * | 5/1960 | Haber | 81/185 |
| 3,177,910 | A | * | 4/1965 | daSilva | 81/177.2 |
| 3,187,610 | A | * | 6/1965 | Russman | 81/185 |
| 3,285,106 | A | * | 11/1966 | Svenson | 81/185 |
| 3,298,261 | A | * | 1/1967 | Lynn | 81/185 |
| 5,157,995 | A | * | 10/1992 | Nogues | 81/124.5 |
| 5,163,344 | A | * | 11/1992 | Mathers | 81/124.5 |

* cited by examiner

*Primary Examiner*—Joseph J. Hail, III
*Assistant Examiner*—David B. Thomas
(74) *Attorney, Agent, or Firm*—Jacobson Holman PLLC

(57) ABSTRACT

A socket mounted on the actuating handle of a socket wrench. The socket includes a hollow body member housing a number of individual sockets, which individual sockets can be moved inwards into the hollow body member to provide a socket of the correct size to engage a hexagonal bolt or nut. There is thus no longer the need to provide a number of sockets for placing on the socket wrench. The one socket will accommodate a large number of sizes.

20 Claims, 14 Drawing Sheets

1
10
12
13
20
19
36(a)
35(a)

1
10
12
13
15
16
17
18
20
19
36(b)
35(b)

1
10
12
13
36(c)
35(c)

4
46
44
45
43
42
41
2
40

4
54
53
52
51
50

69
68
65
66
67
64
63
62
61
71
70
71
60

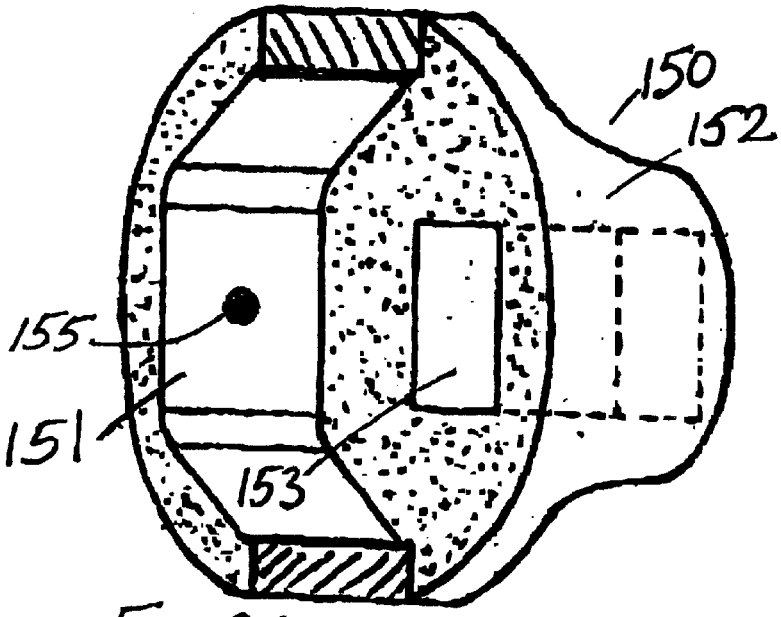
FIG 24
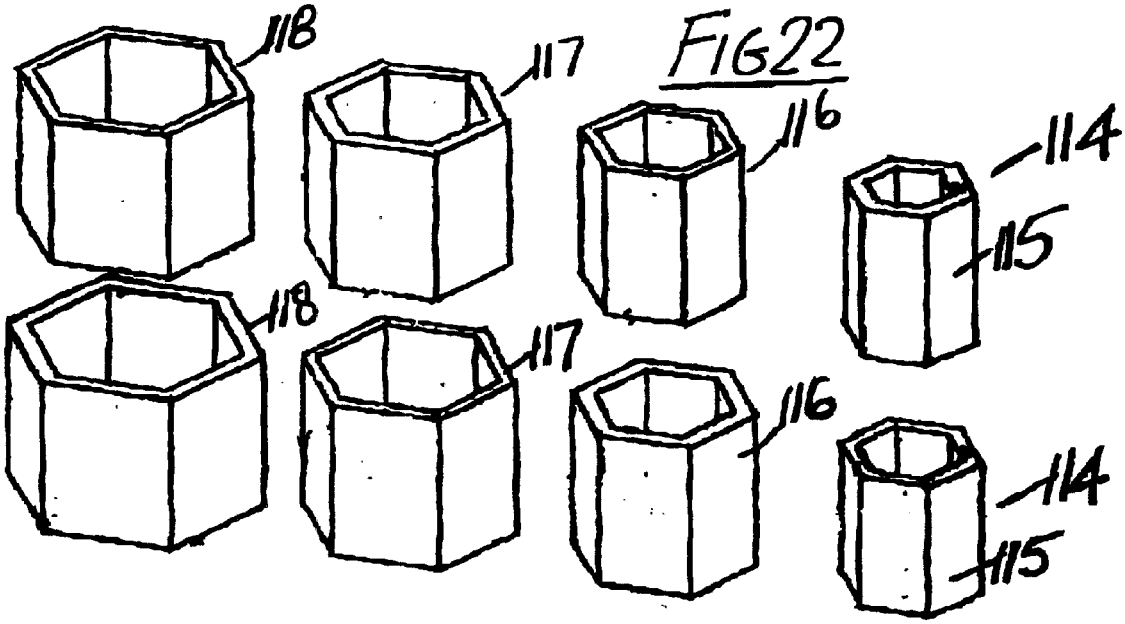
FIG 22
FIG 23

SOCKET FOR A SOCKET WRENCH

This application is a continuation-in-part of U.S. patent application Ser. No. 09/308,235, filed Jun. 10, 1999, now abandoned, which is a nationalization of PCT/IE97/00079, filed Nov. 21, 1997, published in English.

BACKGROUND OF THE INVENTION

The present invention relates to socket wrenches and in particular to the sockets forming part of such socket wrenches.

It is well known to provide a wrench in the form of a socketed head having a hollow end to fit over a multisided head of a nut or bolt, generally a hexagonally sided nut or bolt. The socket may be permanently attached to an actuating handle in which case generally only one size or at most only two sizes of sockets may be provided, or there is provided a plurality of removable socket heads or as they are more generally called sockets. The latter type of wrench namely one comprising a handle and a plurality of removable sockets is the more commonly provided type of socket wrench since the latter is more versatile allowing a plurality of sizes of nut or bolt to be handled by the one set of sockets. Indeed, the term "a set of sockets" is commonly used to include not just the socket heads or sockets per se, but also the combination of the socket heads and the actuating handle, which actuating handle in turn often comprises a rod having pivotally mounted on one end thereof a square sectioned male spud, each individual socket having on the end opposite to its, hexagonally formed portion a square sectioned hole or more properly socket adapted to receive the socket.

The versatility of sets of sockets has long been appreciated, however, the main disadvantage with them is that they tend to be mislaid. There is nothing more frustrating for a workman than to find when he goes to look for a particular socket that it is unavailable to him or her. It may simply have been mislaid previously in which case there is no possibility of using it immediately, or, alternatively it has been mislaid in around the workplace requiring a search to be carried out and therefore delay.

A further minor problem is when one wishes to use more than one size of socket one is forced to carry on one's person possible sizes of sockets so that they may be available when required.

Another problem with using sets of sockets is that it is necessary to provide a large number of sockets to accommodate a wide range of size of hexagonal bolts and nuts. This problem is exacerbated in countries where previously some other standard for size of bolt head or nut head was used such as imperial rather than the metric sizes more commonly used now.

Attempts have been made in the past to provide a socket for a socket wrench which will overcome these problems. A typical example of these attempts is a socket imitating wrench carrying a plurality of pins which are movable inwards against individual spring biasing so that a bolt head after the socket is pushed onto it is subsequently surrounded by the pins remaining. Such a wrench is sold under the brand name GATOR GRIP. Unfortunately these pins do not provide adequate grip on the bolt head, the pins damage the bold head, the pins do not transmit the torque adequately or positively, the pins fail under high torque and finally, the so-called socket wrench will in many instances grip the nut off centre with respect to the applied torque. Generally speaking it is an unsatisfactory construction.

Other examples of prior art multiple socket wrenches are to be found in U.S. Pat. No. 1,395,528, U.S. Pat. No. 1,626,730 and U.S. Pat. No. 2,453,901. However, these devices only provide a very limited number of sockets and their constructions are such that only such a limited number of sockets are possible in these devices.

The present invention is directed towards overcoming these and other problems.

SUMMARY OF THE INVENTION

According to the invention, there is provided a socket for a socket wrench of the type comprising an actuating handle carrying the socket, the socket comprising:

- a tubular body,
- the body having two opposed end portions on either side of a hollow central portion,
- a set of nesting individual sockets on the body at each end of the body, each set of sockets being housed within an end portion of the body,
- each adjacent pair of nesting sockets in a set of sockets comprising an inner socket and an outer socket, said inner socket being movable axially inwardly relative to the outer socket to expose said outer socket for use,
- an exterior of the body at each end of the body being adapted for engagement with a lever for rotation of the sockets.

It will be appreciated that there is considerable advantage in having sets of nesting sockets on one body in a compact construction, instead of having to carry a large number of separate sockets on one's person.

Ideally it will be appreciated that there will be more than two nesting sockets. In general there will be a plurality of nesting sockets.

In one embodiment, each nesting socket engages resiliently the other nesting socket or sockets, to require positive disengagement and reinforcement thus preventing the sockets from falling in and out of engagement by providing a force fit of an inner socket within the outer socket. One way of achieving this is to provide on each socket a spring on the outer surface thereof to engage on the inner surface of the next outermost socket. Various forms of springs may be provided such as are often seen conventionally in socket sets being resiliently mounted ball bearings or the like, indeed anything which provides a resistance against relative movement is sufficient.

Ideally the springs when used vary in strength decreasing from the outermost socket to the innermost socket of the set to ensure when the innermost socket is pushed inwards within the other socket, that the other socket it will not carry the outermost sockets with it.

In another embodiment of the invention, each of the nesting sockets is biased outwardly, preferably by means of a spring. For example, each movable socket may be connected to a rear of the outermost socket by means of a helical spring thus providing in the central portion of the outer socket a nest of helical springs each of which biases a corresponding socket outwardly or alternatively they may be biased in a cascade effect.

Ideally, restraining means in the form of a stop are provided to prevent a nesting socket fully withdrawing from its surrounding sockets. The advantage of this is that it is then impossible to lose the sockets of the set.

In one embodiment of the invention, an exposed end of each socket is bevelled inwardly. Further, each successively smaller socket in a nest can be slightly recessed with respect to an adjacent larger socket.

In a particularly preferred embodiment of the invention, there is provided a socket comprising two separate sets of sockets axially spaced apart within an elongate body member and an adaptor for engaging over each end of the body member, the adaptor terminating in an actuating handle engaging socket.

A further advantage in having sockets at both ends is that in addition to providing a versatile range of sockets it is also possible to provide for example metric and imperial sized sockets in the one set which is exceptionally advantageous For example, having fourteen sockets from 6 mm to 32 mm means that while fitting fourteen sizes exactly you are only 1 mm out on the intermediate sizes. The same will apply to imperial sizes.

Ideally each external surface surrounding the end portion is regular sided to form a male portion to engage a female socketed portion of a handle or an adaptor for mounting on the handle. This, it will be appreciated is advantageous, because it means that an easy connection between a handle and the body portion may be achieved.

Ideally the body portion itself has each end portion in the form of a socket thus utilising the body member itself as a socket.

In one embodiment of the invention the handle is a two-part handle comprising a rod having pivotally mounted on one end thereof a square sectioned male spud and a hollow adapter sleeve, one end of which is socketed to engage the external surface of a set of nesting sockets and the other end of which is socketed to receive the male spud. The advantage of this is that now the conventional handle of a conventional set of sockets may be used.

In another embodiment of the invention instead of providing a hollow adapter sleeve the innermost socket of a set of sockets is dimensioned to receive the spud of the handle. In this way it is even more versatile than could be possibly envisaged in that it is now possible to provide in effect a socket that can be used with any conventional actuator handle.

One of the particular advantages of the present invention is that where a wide range of sizes of sockets are required, they can be relatively easily provided.

In a particularly preferred embodiment, locking means is provided for selectively locking each individual socket on the body. Thus advantageously the selected socket wrench element is prevented from retracting on the housing when it is required for use.

In one embodiment the locking means comprises a selector switch on the body which is operable to position an associated selector pin on the housing for engagement with a selected socket wrench element to prevent retraction of the socket wrench element on the body.

Preferably the selector switch is slidably mounted in a circumferential slot in a side wall of the body, the selector switch extending through the slot to engage the selector pin which is mounted within the body.

Conveniently the selector pin is engagable within a number of spaced-apart grooves on an inside face of the body for alignment with each socket wrench element.

Preferably the selector switch is biased outwardly by a spring or the like to positively engage the selector pin in the grooves.

For convenience the selector switch and selector pin are mounted on a switch plate which is engagable in a side wall opening or window in the body.

In another embodiment each socket wrench element has an outwardly extending lug at an inner end of the socket wrench element for engagement with the selector pin.

In a further embodiment said lugs are engagable with an associated land or ledge within the body to retain the socket wrench elements within the body.

In another embodiment a spring is mounted within the body for engagement with the innermost socket wrench element in each set of nesting sockets to urge the sockets outwardly on the body.

Preferably the spring is engagable between the innermost sockets.

In another embodiment an outside face of each end portion of the housing has a hexagonal configuration.

In another aspect, the invention provides a socket as described herein in combination with an adapter having a mounting socket for reception of each end of the body to releasably mount the adapter on the body, said adapter having means for engagement with an actuating lever for rotating the adapter and socket. Preferably, the adapter has a spring loaded locking ball mounted on an inside wall of the mounting socket which is engagable with complementary receiver slots at each end of the body to releasably retain the adapter on the body.

BRIEF DESCRIPTION OF THE DRAWINGS

The invention will be more clearly understood from the following description of an embodiment thereof given by way of example only with reference to the accompanying drawings in which:

FIG. 22 is a perspective view of an associated set of socket wrench elements;

FIG. 23 is a perspective view of another set of socket wrench elements; and

FIG. 24 is a perspective partially sectioned view of an adapter drive for the socket wrench.

DETAILED DESCRIPTION OF THE PREFERRED EMBODIMENTS

Figure 1:
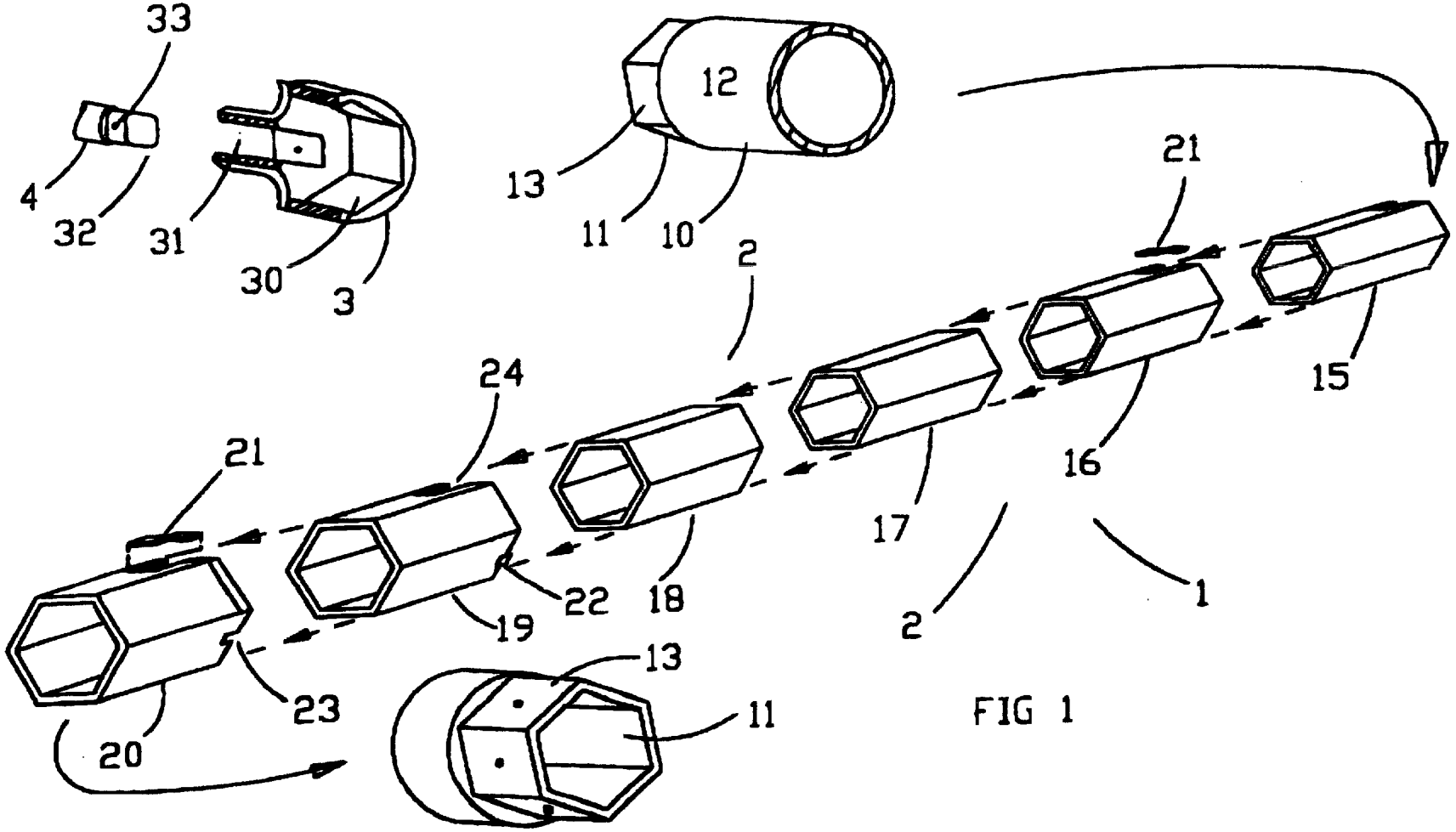
FIG. 1 is an partially exploded perspective view of a socket with part of a socket wrench.
Figure 2:
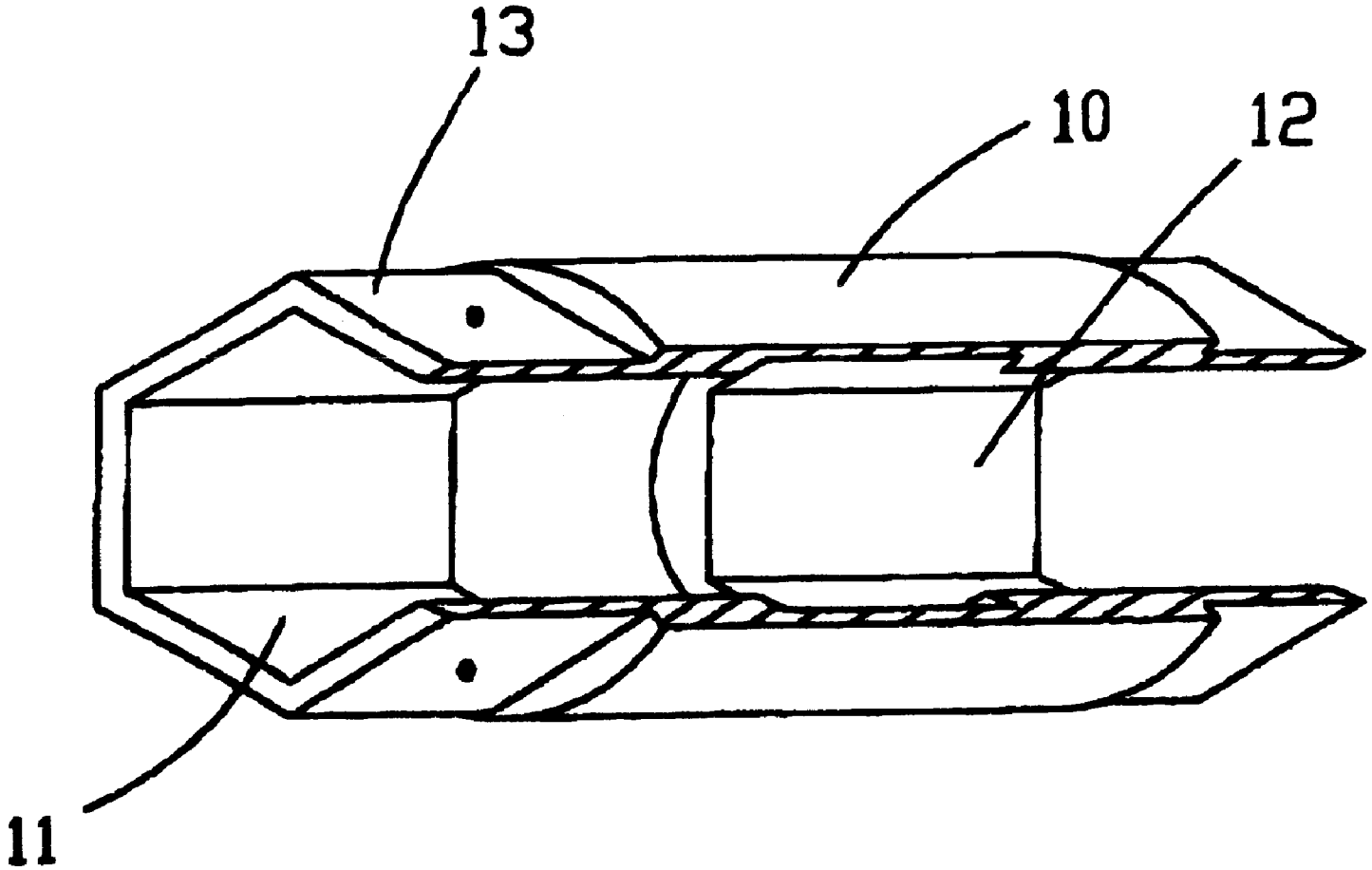
FIG. 2 is a partially cut-away view of portion of an individual socket of FIG. 1.

Referring to the drawings and initially to FIGS. 1 to 6 thereof there is illustrated portion of a socket for a socket wrench the socket being indicated generally by the reference numeral 1 comprising two sets of sockets indicated by the reference numeral 2, including a hollow adapter 3 and portion of an actuating handle 4. The actuating handle 4 may house a ratchet mechanism as is common and is of generally conventional construction and the sockets according to the invention are for use with such handles which is obvious unless otherwise stated.

The two separate sets of sockets 2 are housed within a hollow body member 10 having two opposed end portions 11 on either side of a hollow central portion 12. Each end portion 11 itself forms a hollow socket and has a hexagonal outer surface 13. A plurality of individual nesting sockets 15, 16, 17, 18, 19 and 20 are provided in each end portion 11. The individual socket 15 is the innermost socket and the individual socket 20 is the outermost socket. While the innermost socket 15 is an inner socket with respect to the next individual socket 16 in which it nests and the socket 16 therefore forms with respect to the innermost socket 15 an outer socket, the outer socket 16 in turn becomes an inner socket with respect of the next outer socket 17 which is therefore an outer socket with respect to the inner socket 16. It will be noted that only one set 2 of sockets is illustrated. Each socket 15–20 carries a spring 21, not all of which are shown. In effect the spring 21 forms a friction-fit between an inner and outer socket. Each socket 15 to 20 inclusive nests inside its next outer socket, thus as stated above the socket 15 nests inside the socket 16, the socket 16 nests inside the socket 17, and so on. Each socket is provided with a stop 22 which engages in a slot 23 in its next outer socket. The stops 22 and slots 23 thus provide restraining means preventing full withdrawal in an axially outwards direction. Not all of these stops 22 or slots 23 are illustrated. It will be noted that each spring 21 engages a recess 24 in its next adjacent socket.

Figure 6:
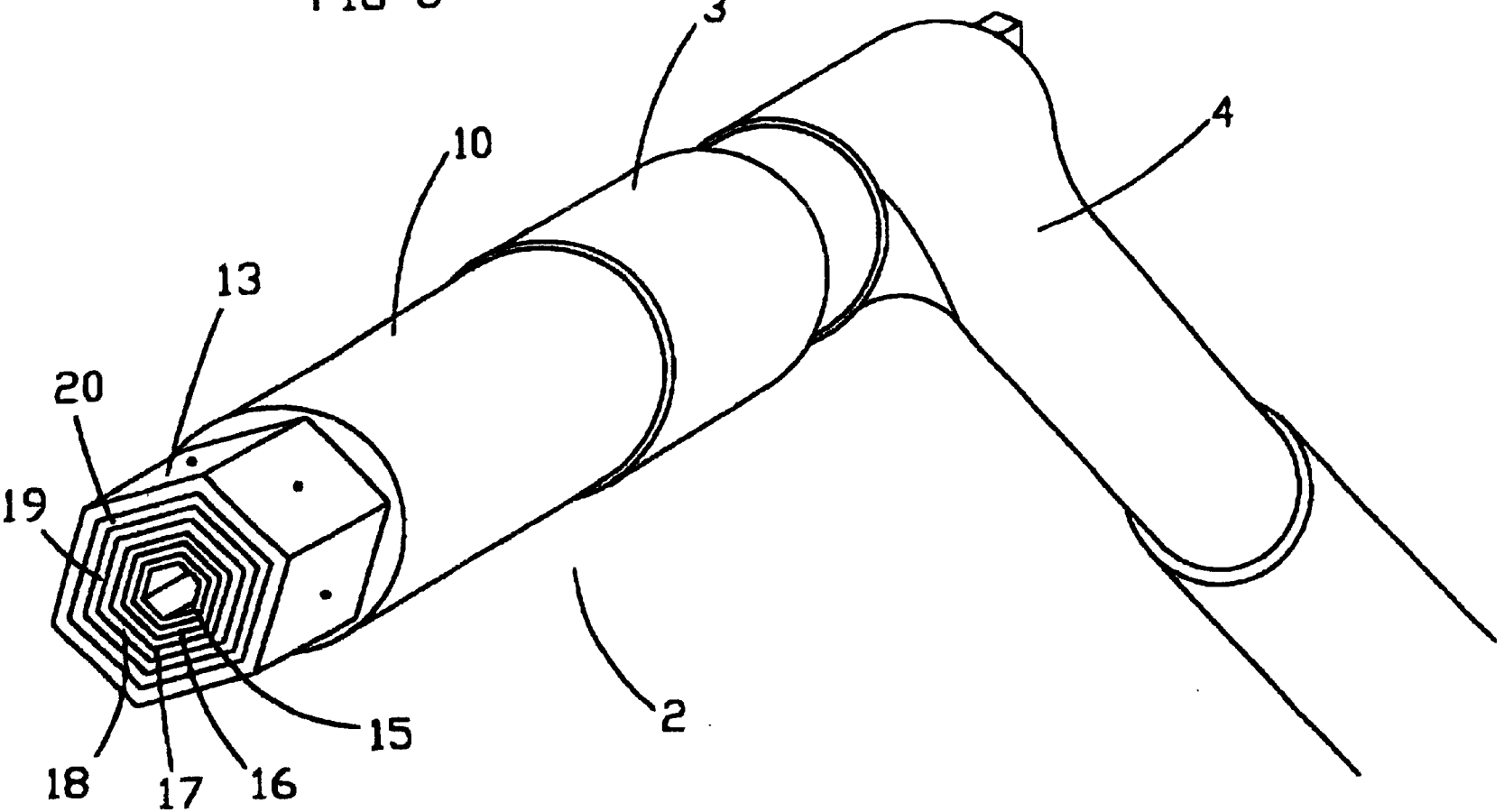
FIG. 6 is a perspective view of an assembled socket wrench according to the invention.

The adapter 3 comprises a hexagonally socketed hollow head 30 terminating in a square sectioned end hole 31 which is adapted to engage a square section spud 32 which is pivotally mounted by a pin 33 on the handle 4 only portion of which is shown. It will be appreciated in use that the adapter 3 and handle 4 may engage the hexagonal outer surface 13 to rotate the socket wrench 1 as illustrated in FIG. 6.

Figures 3A, 3B, 3C:
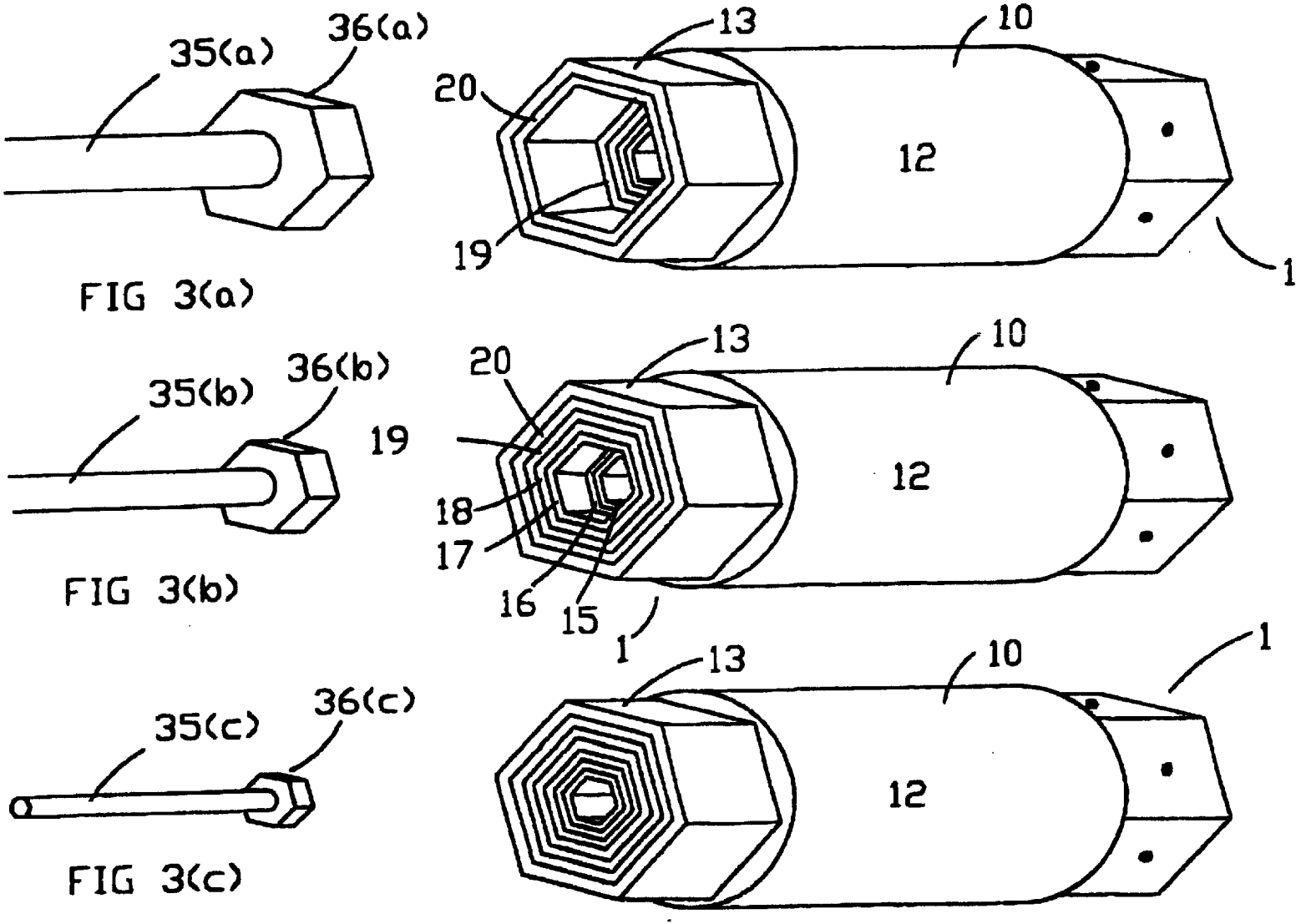
FIGS. 3(*a*), 3(*b*) and 3(*c*) illustrates the socket of FIG. 1 in use.
Figure 4:
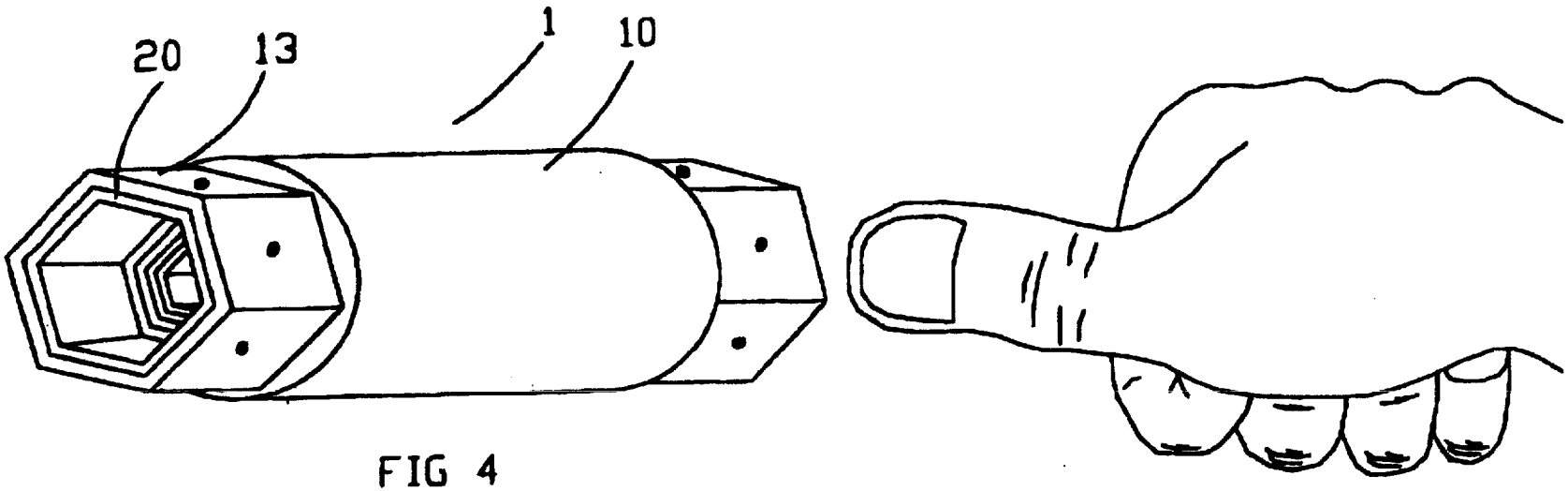
FIGS. 4 and 5 illustrate the socket also in use.
Figure 5:
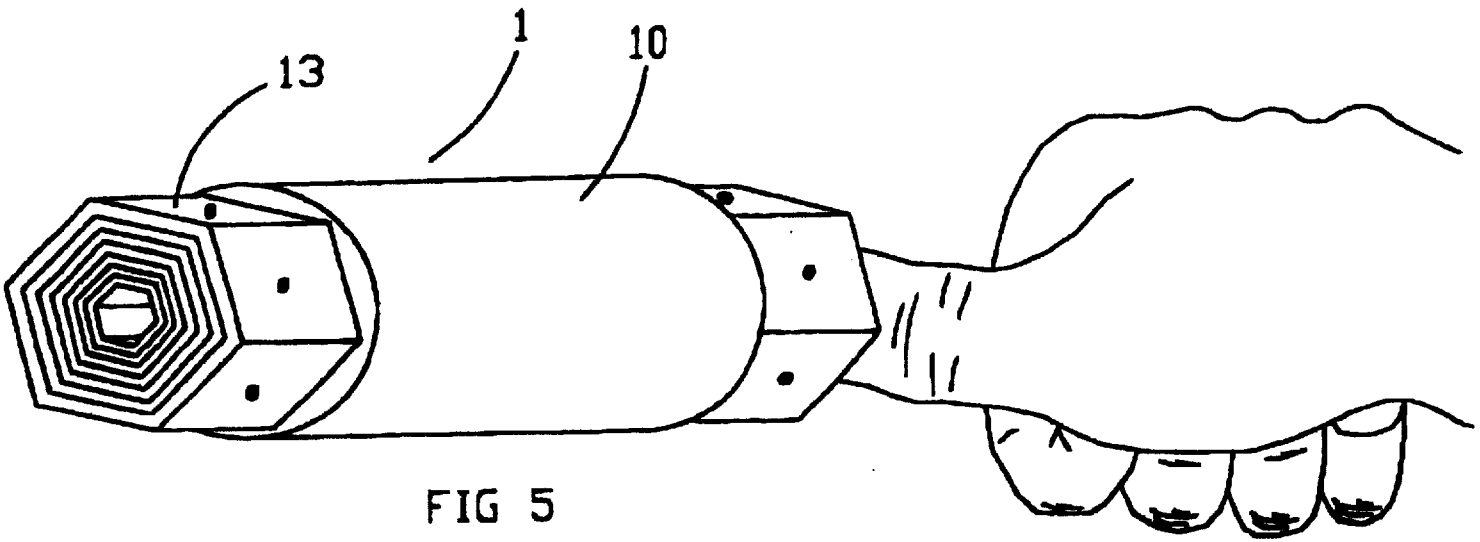

When all the sockets 15–20 nest inside the body member 10 it will be noted that no sockets 15–20 will project into the central portion 12. To select a particular size of socket, for example the sockets of lower or smaller size i.e. if you wish to select socket 18, sockets 17, 16 and 15 would be pushed together inwards so as to expose the socket 18 ready for use which would then be surrounded by the sockets 19 and 20 within the end portion 11. The socket wrench 1 may then be used. This is particularly illustrated in FIG. 3. Referring now specifically to FIG. 3 there is illustrated the socket being offered up to three different sizes of bolt 35(*a*), 35(*b*). and 35(*c*) having different sizes of hexagonal head 36(*a*), 36(*b*) and 36(*c*) respectively. It will be seen how the different sizes of individual socket are required and may be used. If it is desired to bring any set of sockets back to the original position the sockets are merely depressed in the other set which will then push the socket on the other side outwards to the flush position. This is illustrated in FIGS. 4 and 5.

Figures 7, 8, 9:
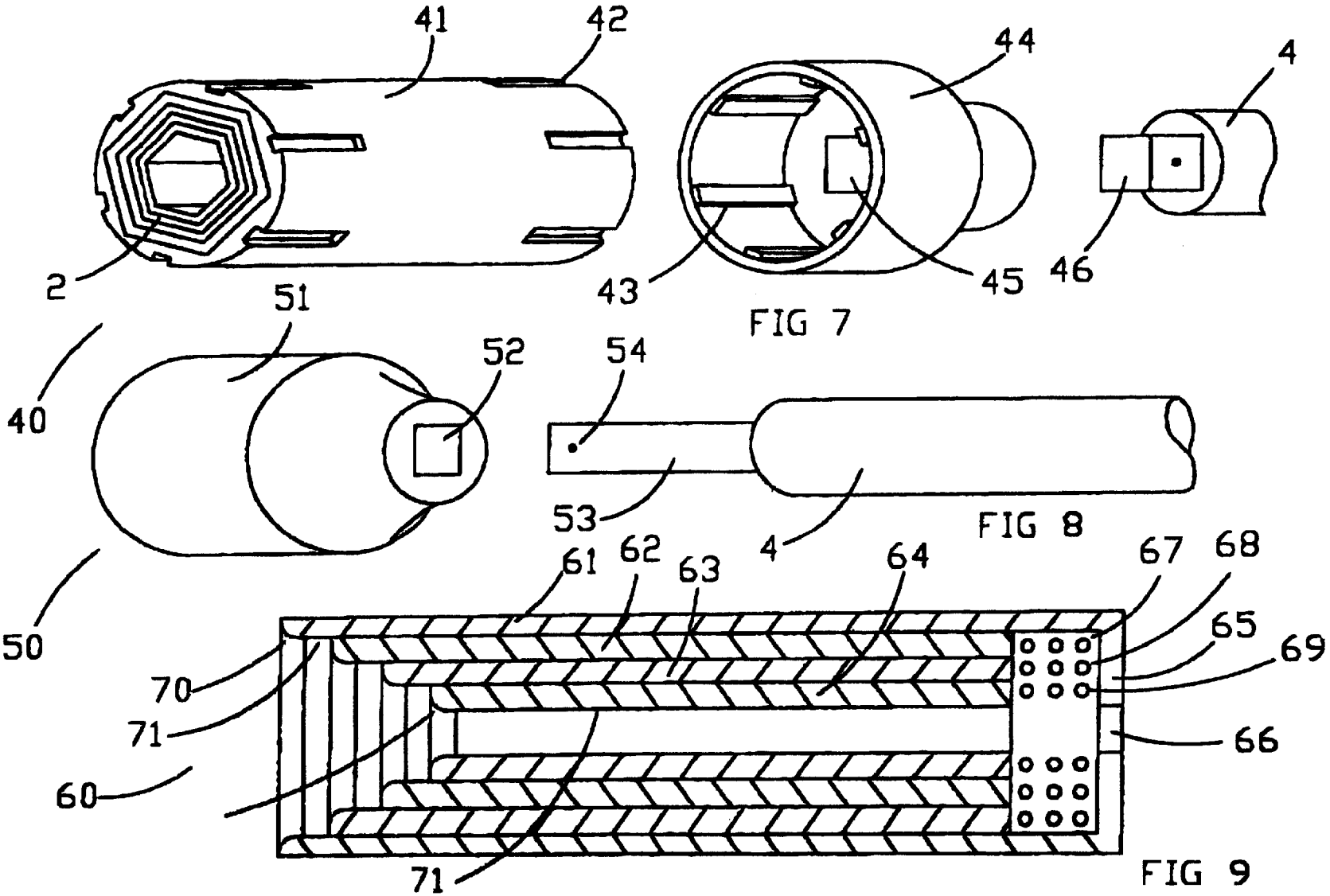
FIG. 7 is an exploded perspective view of another socket and part of an actuating handle according to the invention.
FIG. 8 is an exploded view of a still further socket and part of an actuating handle according to the invention.
FIG. 9 is a sectional view through another socket according to the invention.
Figure 10:
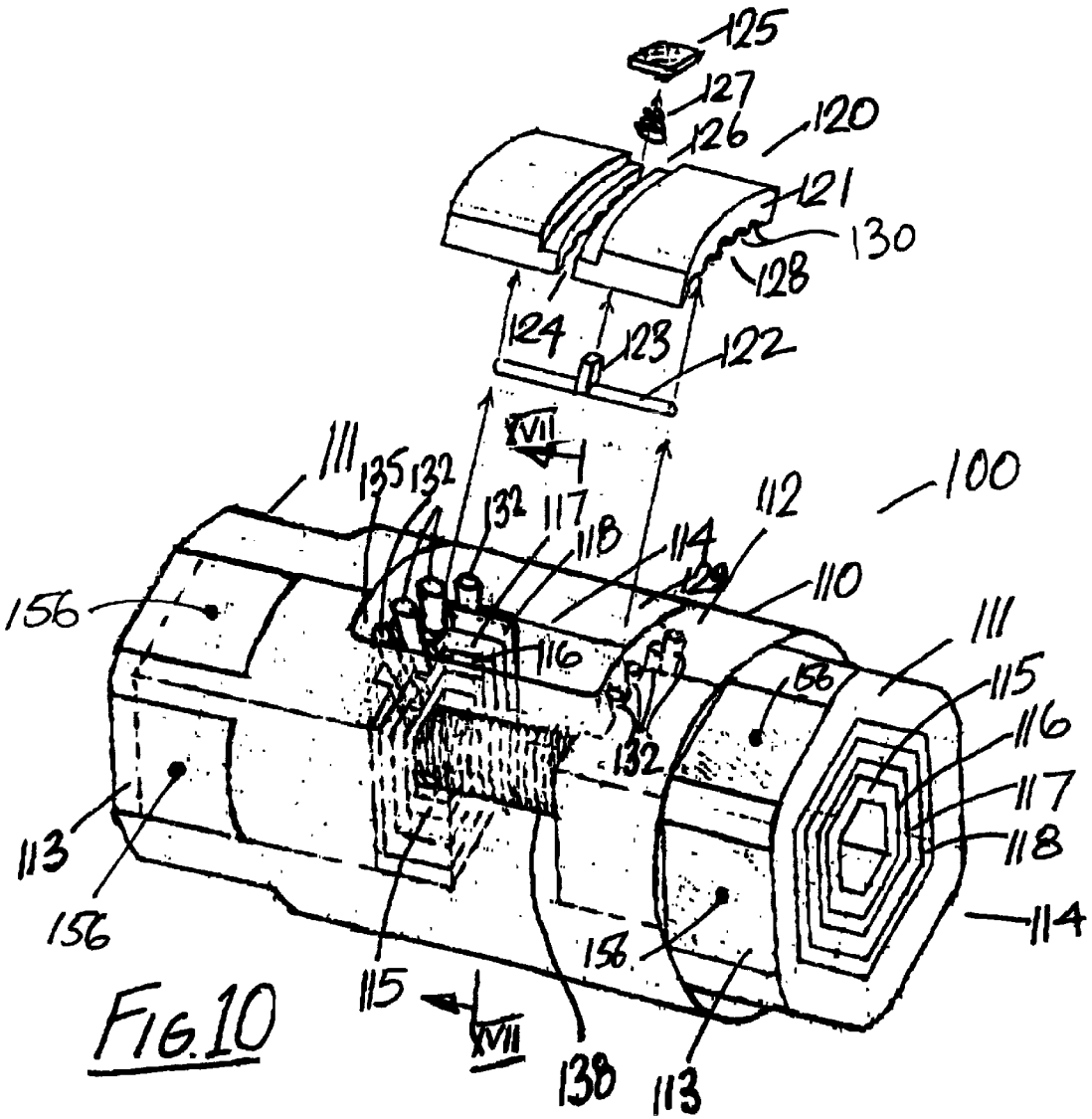
FIG. 10 is a partially exploded perspective view of another multiple socket wrench of the invention.

Referring now to FIG. 7 there is illustrated an alternative construction of socket indicated generally by the reference numeral 40 having a hollow body member 41 having a cylindrical outer surface carrying a plurality of open slots 42 for engagement with axially arranged radial ribs 43 within an adaptor 44 which in turn has a square hole 45 for engagement with a spud 46 mounted on an actuating handle 4.

Referring now to FIG. 8 there is illustrated a further construction of socket 50 for carrying only one set of sockets which socket 50 comprises a hollow cylindrical body member 51 within which are housed individual sockets (not shown). The body member 51 terminate in a square hole 52 for engagement with an elongated square sectioned rod 53 carrying a conventional spring biased locating ball bearing 54 and which body member 51 is mounted on the actuating handle 4. It will be noted that the rod 53 is longer than the conventional spud as is normally used. In use the rod 53 can be pushed inwards so that the spring loaded ball bearing 54 comes out of engagement of whatever depression located in and the rod 53 will push all the individual sockets within the hollow body member 51 out to the flush position. Then the rod 53 can be withdrawn until it takes up the normal position within the square hole 52 and the wrench is operating as before. This is a particularly suitable way of constructing a socket which only contains one set of individual sockets.

Referring to FIG. 9 there is illustrated a still further construction of socket according to the invention indicated generally by the reference numeral 60 carrying four individual sockets, namely sockets 61,62,63 and 64. The outermost socket 61 has a hexagonal outer and inner surface and has an end plate 65 housing a square sectioned hole 66 for reception of a conventional square sectioned spud on an actuating handle. Mounted within the outermost socket 61 and bearing against the end plate 65 are three sets of concentrically arranged helical springs 67,68 and 69 respectively. The helical spring 67 bears against the socket 62. The helical spring 68 bears against the socket 63 and the helical spring 69 bears against the innermost socket 64. Thus the helical springs 67,68,69 bias the sockets 62,63,64 outwards into the extended position. However, it will be noted that each socket is so arranged that in the extended position the end face of an inner socket lies behind the end face of an outer socket. Thus, the innermost socket 64 lies behind its outer socket 63 which in turn lies behind its outer socket 62 and the latter socket 62 lies behind the outermost socket 61.

It will be noted that each socket 61,62,63,64 has an outer surface 70 cut away adjacent its inner bore 71 to provide a smooth lead-in engagement surface. This will facilitate the mounting of individual sockets.

Referring now to FIGS. 10 to 24, there is shown another socket wrench according to the invention indicated generally by the reference numeral 100. The socket wrench 101 has a generally tubular hollow body member forming an outer housing 110 having two opposed end portions 111 on either side of a central portion 112. Each end portion 111 forms a hexagonal socket and has a hexagonal outer surface 113. Two sets of socket wrench elements 114 are mounted on the housing 112, each socket set 114 being nested within one of the end portions 111, both socket sets 114 being in axial alignment. Each socket set 114 comprises a plurality of individual socket wrench elements 115, 116, 117, 118 of different sizes arranged concentrically within the housing 110 and slidable axially relative to each other for engaging a desired socket wrench element 115, 116, 117, 118 with a nut or bolt head (not shown) in use. To allow use of a desired socket wrench element 115, 116, 117, 118 each socket wrench element 115, 116, 117, 118 is axially moveable within the housing 110 between an extended position within the outer end 111 and a retracted position within the central portion 112. A selector switch 120 is operable to lock each socket wrench element 115, 116, 117, 118 when desired to prevent retraction of said socket wrench element 115, 116, 117, 118 into the central portion 12 of the housing 110. Thus in use to engage a desired socket wrench element 115, 116, 117, 118 with an associated nut of a particular size the switch 120 is engaged with the corresponding socket wrench element 115, 116, 117, 118 which is held against retraction whilst the other socket wrench elements 115, 116, 117, 118 within the set 114 of socket wrench elements 115, 116, 117, 118 are free to retract within the central portion 112 to allow reception of the nut within the selected socket wrench element 115, 116, 117, 118. It will be noted that the central portion 112 is sized to accommodate only one set of sockets at a time, thus providing a compact construction.

Figure 14:
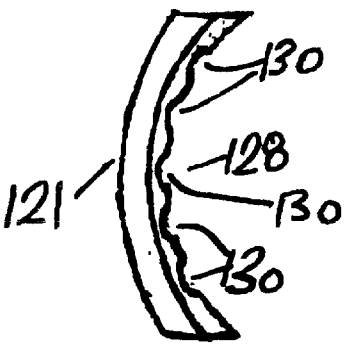
FIG. 14 is an end elevational view of the switch plate.
Figure 13:
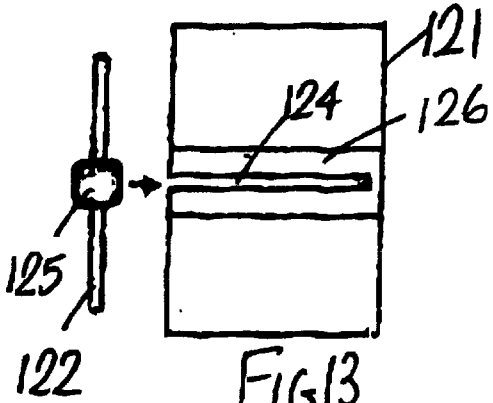
FIG. 13 is a plan view of a switch plate forming portion of a socket locking mechanism for the socket wrench.
Figure 15:
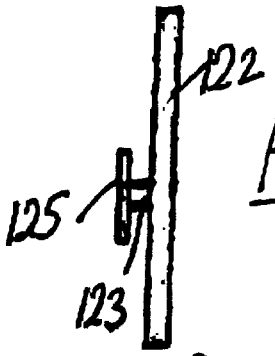
FIG. 15 is an elevational view of a selector pin forming portion of the locking mechanism.
Figure 16:
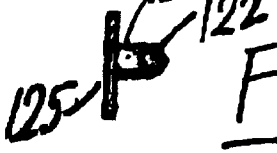
FIG. 16 is an end view of the selector pin.
Figure 11:
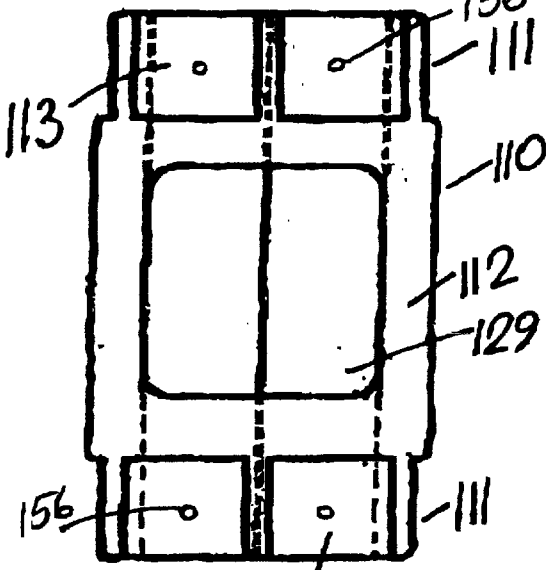
FIG. 11 is an elevational view of a body of the socket wrench of FIG. 10.
Figure 12:
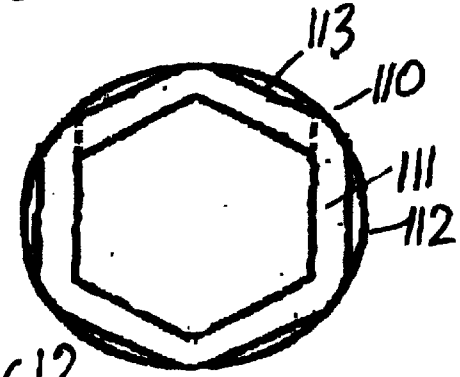
FIG. 12 is and end elevational view of the body.
Figure 17:
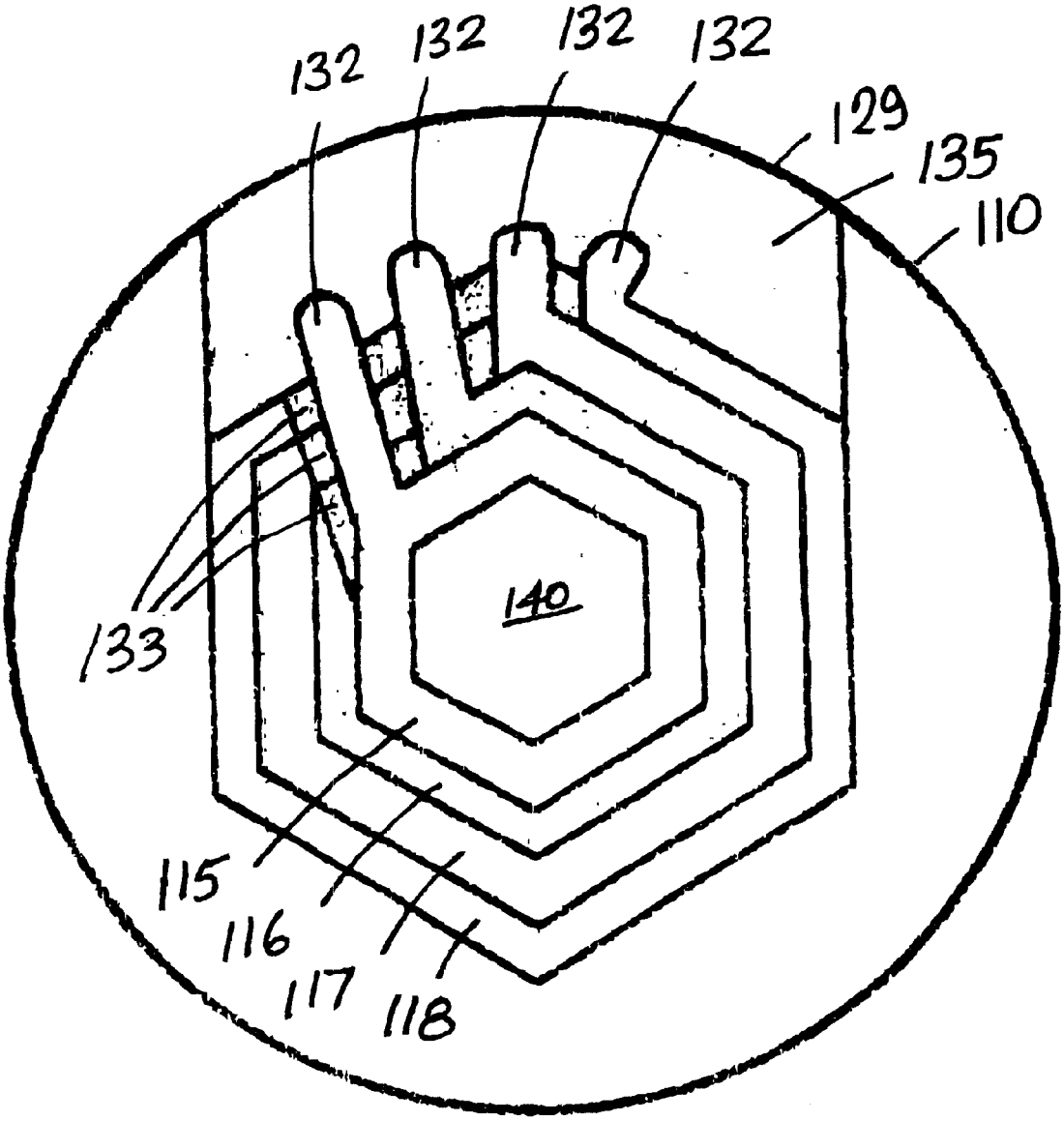
FIG. 17 is a sectional view taken along the line XVII—XVII of FIG. 10.
Figure 18:
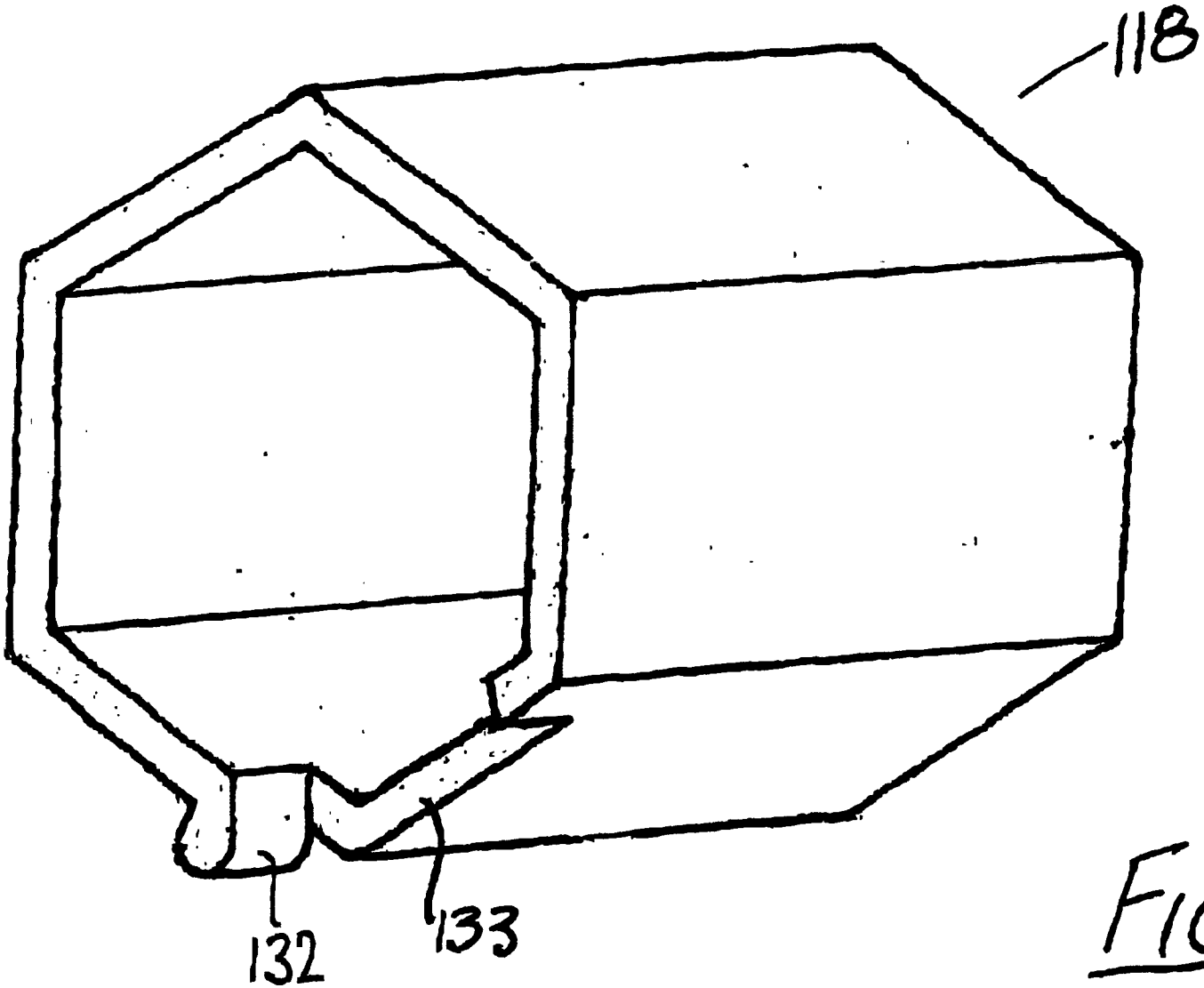
FIG. 18 is a perspective view of a socket wrench element forming portion of the socket wrench.
Figure 19:
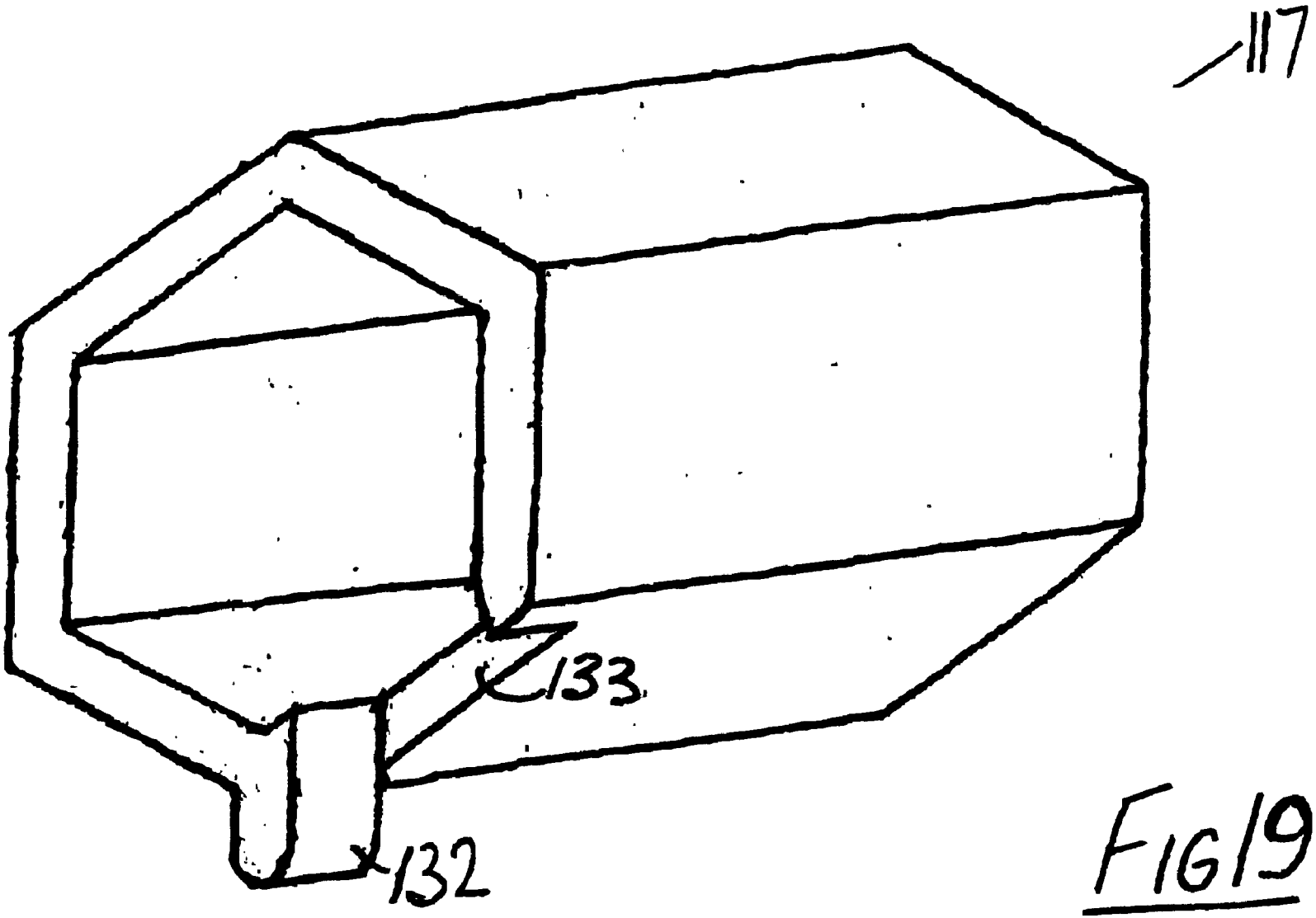
FIG. 19 is a perspective view of a second socket wrench element.
Figure 20:
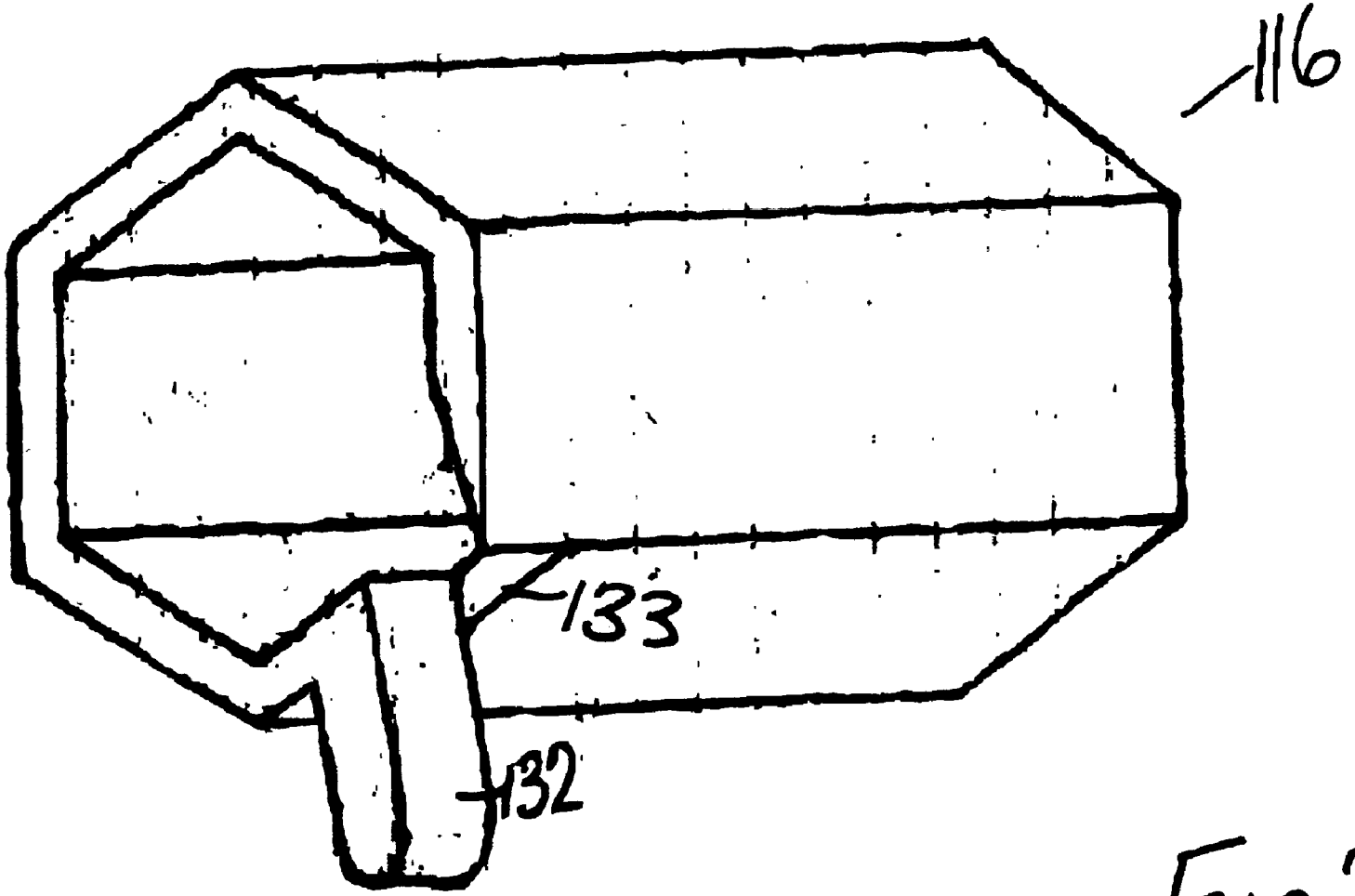
FIG. 20 is a perspective view of a third socket wrench element.

The selector switch 120 comprises a switch plate 121 which is mounted within an associated window 129 in a side wall of the central portion 112 of the housing 110. The switch plate 121 has an associated selector pin 122 with a central projection 123 which extends through a complementary guide slot 124 in the switch plate 121 and is attached to an operating button 125 which locates in and slides along a recessed groove 126 in an outer face of the switch plate 121. A spring 127 is provided beneath the button 125 and extends between the button 125 and the outer face of the switch plate 121 to urge the selector pin 122 against an inside face 128 of the switch plate 121. As can be seen in FIG. 14 the inside face 128 has a number of spaced-apart grooves 130 each for reception of the selector pin 122 to retain the selector pin 122 at a desired location. To move the selector pin 122 the button 125 is depressed against the spring 127 moving the selector pin 122 inwardly and then the button 125 can be slid along the groove 126 and released to allow the selector pin to snap into the selected groove 130 on the inside face of the selector plate 121.

At an inner end of each of the socket wrench element 115, 116, 117, 118 there is provided a lug 132 associated with the selector pin 122. Thus when the selector pin 122 is aligned with a lug 132 it prevents the associated socket wrench element 115, 116, 117, 118 from retracting within the central portion 112 of the housing 110. As can be seen in FIGS. 17 to 21, with the exception of the innermost socket wrench element 115, each socket wrench element 116, 117, 118 has a slot 133 adjacent the lug 132 for through passage of lugs 132 of other socket wrench elements 115, 116, 117, 118 so that outer ends of the lugs 132 are arranged in a row within the housing 110 in the path of the selector pin 122.

Figure 21:
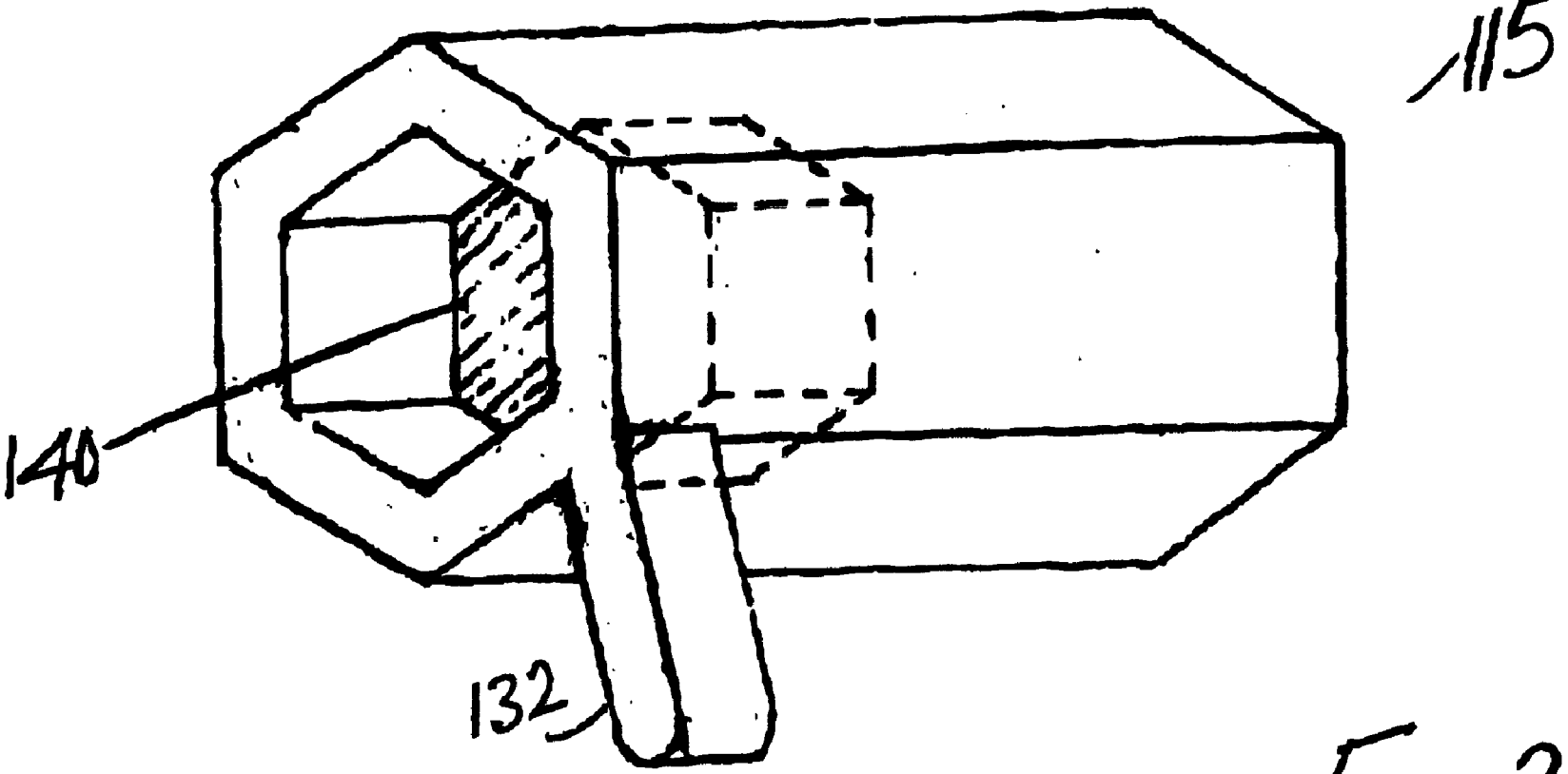
FIG. 21 is a perspective view of a fourth socket wrench element.

It will be noted that an outer end of each lug 132 bears against an associated ledge or land 135 within the window 129 to retain the socket wrench elements 115, 116, 117, 118 within the housing 110. A spring 138 extends between the innermost socket wrench element 115 of each set 114 of socket wrench elements to urge each set of socket wrench elements 114 outwardly with the lugs 132 limiting outward movement. Each of the socket elements 115, 116, 117, 118 can be pushed inwardly against spring 138 pressure to expose an outer socket wrench element 115, 116, 117, 116 for use. As can be seen in FIG. 21 the innermost socket wrench element 115 has adjacent an inner end of its bore a step or landing 140 against which an outer end of the spring 138 engages.

FIGS. 22 and 23 show the two sets of socket elements each set 114 comprising in this case four socket wrench elements 115, 116, 117, 118 which slidably nest one within the other. Thus advantageously in the socket wrench 100 advantageously ten different socket wrench sizes are provided, with each end portion 111 of the housing also forming a socket wrench.

Referring to FIG. 24 there is shown an adapter drive 150 which has at an inner end a hexagonal mounting socket 151 for engagement with the hexagonal outer face 113 at each end 111 of the housing 110. An inner end 152 of the adapter drive 150 has a central square section hole 153 for reception of a standard square drive T-bar, ratchet spanner or the like actuating lever. The adapter drive 150 has a spring loaded locking ball 155 mounted on an inside wall of the mounting socket 151 and projecting outwardly of said inside wall. This locking ball 155 is engagable with complementary receiver slots 156 on each flat face of the hexagonal ends 113 of the body 110. The ball 155 will retract to allow the socket 151 of the adapter 150 to engage with the hexagonal outer surface 113 at each end of the body 110 and, on engagement, the ball 155 will spring outwardly for snap engagement within one of the slots 156 to securely retain the adapter 150 in engagement with the socket 100.

In use a user manipulates the button 125 of the selector switch 120 to align the selector pin 122 with a desired socket wrench element 115, 116, 117, 118 or disengage the selector pin 122 altogether if the selected socket wrench is formed by the end 111 of the housing 110. The socket wrench 100 is then engaged with a nut or bolt with the socket wrench element 111, 115, 116, 117, 116 being held steady whilst redundant inner socket wrench elements 115, 116, 117, 118 are pushed by the nut or bolt inwardly into the central portion 112. Thus positive and secure engagement of the required socket wrench element 111, 115, 116, 117, 118 with the nut or bolt is achieved. It will be appreciated that the selector switch 120 can be quickly and easily operated to select any desired socket element 111, 115, 116, 117, 118.

While all the sockets above have been described with reference to hexagonal headed nuts and bolts and undoubtedly hexagonal headed nuts and bolts constitute the majority of units which need to be actuated by a socket wrench it will be appreciated that any other shape of multi-sided unit and corresponding socket could be provided.

The invention is not limited to the embodiments hereinbefore described which may be varied in both construction and detail within the scope of the appended claims.

What is claimed is:

1. A socket for a socket wrench of the type comprising an actuating handle carrying the socket, the socket comprising:

a tubular body, the body having two opposed end portions on either side of a hollow central portion, a set of nesting individual sockets on the body at each end of the body, each set of sockets being housed within an end portion of the body, each adjacent pair of nesting sockets in a set of sockets comprising an inner socket and an outer socket, said inner socket being movable axially inwardly relative to the outer socket to expose said outer socket for use, an exterior of the body at each end of the body being adapted for engagement with a lever for rotation of the sockets, locking means being provided for selectively locking each individual socket on the body, said locking means comprising a selector switch on the body which is operable to position an associated selector pin on the body for engagement with a selected individual socket to prevent retraction of said selected individual socket on the body, each individual socket having an outwardly extending lug at an inner end of said socket for engagement with the selector pin, said lugs being engagable with an associated land within the body to retain the individual sockets within the body, a spring being mounted within the body for engagement between the innermost individual sockets in each set of nesting sockets to urge each socket outwardly engaging the lug on the socket with the land on the body.

2. A socket as claimed in claim 1 in which an inner socket is a friction-fit within the outer socket.

3. A socket as claimed in claim 2 in which the friction-fit is provided by a spring urged means interposed between the inner and outer sockets.

4. A socket as claimed in claim 2 in which the friction-fit is provided by a leaf spring secured to an outer surface of the inner socket and cantilevered upwards to bear against an inner surface of the outer socket.

5. A socket as claimed in claim 1 in which there is provided restraining means for preventing full withdrawal of an inner socket from an outer socket in an axially outward direction.

6. A socket as claimed in claim 2 in which the friction-fit provided decreases from the outermost socket to the innermost socket.

7. A socket as claimed in claim 1 in which, in an extended position, an end face of an inner socket lies behind an end face of an outer socket.

8. A socket as claimed in claim 1 in which an outer surface of each individual socket is cut away adjacent an inner bore of said socket to provide a smooth lead-in engagement surface.

9. A socket as claimed in claim 1 in which an outer and an inner surface of each individual socket are hexagonal.

10. A socket as claimed in claim 1 in which each individual socket is spring biased axially outwards.

11. A socket as claimed in claim 1 in which the spacing between the sets of sockets is chosen to accommodate only one set of sockets whereby pushing an individual socket into the spacing will eject any other facing individual socket it contacts.

12. A socket as claimed in claim 1 in which there is provided an adaptor for engaging of the outermost socket which adapter terminates in an actuating handle engagement hole.

13. A socket comprising two separate sets of sockets as claimed in claim 1 axially spaced apart within an elongate body member and an adaptor for engaging over each end of the body member, the adaptor terminating in an actuating handle engaging socket.

14. A socket as claimed in claim 12 in which the body member has a cylindrical outer surface having a plurality of open slots adjacent each end for engagement with axially arranged radial ribs in a bore of an adapter.

15. A socket as claimed in claim 1, wherein the selector switch is mounted in a slot in a side wall of the body, the selector switch extending through the slot to engage the selector pin which is mounted within the body, the selector pin being engagable with a number of spaced-apart grooves on an inside face of the body for alignment with each individual socket, the selector switch being biased outwardly to engage the selector pin in the grooves, the selector switch being movable inwardly against said bias to disengage the selector pin from the grooves.

16. A socket as claimed in claim 1, in combination with an adapter having a mounting socket for reception of each end of the body to releasably mount the adapter on the body, said adapter having means for engagement with an actuating lever for rotating the adapter and socket, the adapter having a spring loaded locking ball mounted on an inside wall of the mounting socket which is engagable with complementary receiver slots at each end of the body to releasably retain the adapter on the body.

17. A socket for a socket wrench of the type comprising an actuating handle carrying the socket, the socket comprising:

a tubular body, the body having two opposed end portions on either side of a hollow central portion, a set of nesting individual sockets on the body at each end of the body, each set of sockets being housed within an end portion of the body, each adjacent pair of nesting sockets in a set of sockets comprising an inner socket and an outer socket, said inner socket being movable axially inwardly relative to the outer socket to expose said outer socket for use, an exterior of the body at each end of the body being adapted for engagement with a lever for rotation of the sockets, an inner socket being a friction-fit within the outer socket, the friction fit being provided by a leaf spring secured to an outer surface of the inner socket and cantilevered upwards to bear against an inner surface of the outer socket.

18. A socket for a socket wrench of the type comprising an actuating handle carrying the socket, the socket comprising:

an elongate tubular body, the body having two opposed end portions on either side of a hollow central portion, a set of nesting individual sockets on the body at each end of the body, each set of sockets being housed within an end portion of the body, said two sets of sockets being axially spaced apart within the body, each adjacent pair of nesting sockets in a set of sockets comprising an inner socket and an outer socket, said inner socket being movable axially inwardly relative to the outer socket to expose said outer socket for use, an exterior of the body at each end of the body being adapted for engagement with a lever for rotation of the sockets, and an adapter for engaging over each end of the body member, the adapter terminating in an actuating handle engaging socket.

19. A socket for a socket wrench of the type comprising an actuating handle carrying the socket, the socket comprising:

a tubular body, the body having two opposed end portions on either side of a hollow central portion, a set of nesting individual sockets on the body at each end of the body, each set of sockets being housed within an end portion of the body, each adjacent pair of nesting sockets in a set of sockets comprising an inner socket and an outer socket, said inner socket being movable axially inwardly relative to the outer socket to expose said outer socket for use, an exterior of the body at each end of the body being adapted for engagement with a lever for rotation of the sockets, and an adapter for engaging an outermost socket, which adapter terminates in an actuating handle engagement hole, the body having a cylindrical outer surface having a plurality of open slots adjacent each end for engagement with axially arranged radial ribs in a bore of the adapter.

20. A socket for a socket wrench of the type comprising an actuating handle carrying the socket, the socket comprising:

a tubular body, the body having two opposed end portions on either side of a hollow central portion, a set of nesting individual sockets on the body at each end of the body, each set of sockets being housed within an end portion of the body, each adjacent pair of nesting sockets in a set of sockets comprising an inner socket and an outer socket, said inner socket being movable axially inwardly relative to the outer socket to expose said outer socket for use, an exterior of the body at each end of the body being adapted for engagement with a lever for rotation of the sockets, and an adapter having a mounting socket for reception of each end of the body to releasably mount the adapter on the body, said adapter having means for engagement with an actuating lever for rotating the adapter and socket, the adapter having a spring loaded locking ball mounted on an inside wall of the mounting socket which is engagable with complementary receiver slots at each end of the body to releasably retain the adapter on the body.

* * * * *